US006443136B1

(12) United States Patent
Suganami et al.

(10) Patent No.: US 6,443,136 B1
(45) Date of Patent: Sep. 3, 2002

(54) BREATHER APPARATUS FOR AN INTERNAL COMBUSTION ENGINE

(75) Inventors: Tomoji Suganami; Yukio Konishi; Masahiro Takehana, all of Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/983,793

(22) Filed: Oct. 25, 2001

(30) Foreign Application Priority Data

Oct. 25, 2000 (JP) ..... 2000-325053
Oct. 25, 2000 (JP) ..... 2000-325054

(51) Int. Cl.[7] ..... F01M 13/04; F01M 13/00
(52) U.S. Cl. ..... 123/572
(58) Field of Search ..... 123/572, 573, 123/574, 41.86

(56) References Cited

U.S. PATENT DOCUMENTS 4,565,164 A * 1/1986 Satoh et al. ..... 123/41.86
4,602,595 A * 7/1986 Aoki et al. ..... 123/41.86
4,721,090 A * 1/1988 Kato ..... 123/572
4,723,529 A * 2/1988 Yokoi et al. ..... 123/573
4,958,613 A * 9/1990 Hiraoka et al. ..... 123/572
5,069,192 A * 12/1991 Matsumoto et al. ..... 123/572
5,129,371 A * 7/1992 Rosalik, Jr. ..... 123/41.86

FOREIGN PATENT DOCUMENTS

JP 2532890 1/1997
JP 10-30423 2/1998

* cited by examiner

*Primary Examiner*—Marguerite McMahon
(74) *Attorney, Agent, or Firm*—Armstrong, Westerman & Hattori, LLP

(57) ABSTRACT

An internal combustion engine with a breather apparatus, has: a cylinder head cover having a top wall and a circumferential wall which define an internal upper space within the cylinder head cover; and a bottom plate closing an opening at a lower end of the circumferential wall of the cylinder head cover to form a gas-liquid separation chamber. The bottom plate is inclined when the engine is set in a normal posture. A recessed portion for holding oil and serving as an oil return port is formed in a lowest portion along an edge portion of a lower side of a circumferential edge portion of the inclined bottom plate in such a manner as to straddle the circumferential wall from below. Thus, a lower end portion of the circumferential wall is brought into contact with oil held in the recessed portion to thereby close the oil return port airtightly.

10 Claims, 7 Drawing Sheets

BREATHER APPARATUS FOR AN INTERNAL COMBUSTION ENGINE

BACKGROUND OF THE INVENTION

1. Field of the Invention

The present invention relates to a breather apparatus provided with a gas-liquid separation chamber for separating oil contents from blow-by gases produced in an internal combustion engine.

2. Description of the Related Art

A gas-liquid separation chamber for separating oil contents from blow-by gases is usually provided on a blow-by gas returning device for retuning blow-by gases leaking from between the pistons and cylinder walls in an internal combustion engine to an intake system for combustion therein so that blow-by gases from which oil has been removed are then returned to the intake system so as to suppress the consumption of oil.

Shown in FIGS. 7 and 8 is an example of an internal combustion engine 01 described in Japanese Utility Model Registration No. 2532890 in which a gas-liquid separation chamber of a type described above is provided within a cylinder head cover which covers a valve system from thereabove.

A valve train 05 is covered with a cylinder head cover 03 which is overlaid on a cylinder head 02 to be joined thereto.

A rectangular opening at a lower end of a side frame wall 04 which forms an upper space within the cylinder head cover 03 is closed with a bottom plate 06 so as to form a gas-liquid separation chamber 07.

A blow-by gas outlet pipe 08 is provided in such a manner as to penetrate through the side frame wall 04, and a blow-by gas inlet port 09 is opened in the bottom plate 06 along a corner portion which is situated away from the blow-by gas outlet port 08.

Then, three bent portions 010 which are each bent to be inclined downwardly are provided at portions along a side edge of the circumferential edge portion of the rectangular bottom plate 06 where the blow-by gas outlet pipe 08 is situated, and a gap 011 through which oil is to be returned is formed in each bent portion 010 between a lower end face of the side frame wall 04 and the bent portion 010.

Blow-by gases in the cylinder head cover 03 flow into the gas-liquid separation chamber 07 through the blow-by gas inlet port 09, and the blow-by gases from which oil contents have been removed are then returned to the intake system through the blow-by gas outlet port 08.

Oil separated from the blow-by gas and collected on an upper surface of the bottom plate 06 flows over the bottom plate 06 which is inclined along the inclination of the internal combustion engine toward the oil return gaps 011, and oil so reaching the gaps flows out through the oil return gaps 011 into the lower space in which the valve train is accommodated.

The oil return gaps 011 are closed with oil which tries to flow out therethrough, so as to prevent blow-by gases present within the cylinder head cover 03 from being blown up into the gas-liquid separation chamber 07 through the oil return gaps 011.

However, in the event that there is little oil flowing out through the oil return gap 011, there may be a case where the gap is not closed with oil, and if this occurs, there may be a case where blow-by gases within the cylinder head cover 03 is blown up into the gas-liquid separation chamber 07 via the gaps 011, resulting in a risk that oil separated from blow-by gases mixes again with the blow-by gases so blown up into the gas-liquid separation chamber to be sent into the intake system.

If the oil return gap 011 is narrowed, the gap 011 can easily be closed with oil, but there may be a case where the gap 011 is rigidly closed with oil due to its viscosity, resulting in a risk that oil is difficult to flow out through the gap 011 before a lot of oil is accumulated on the upper surface of the bottom plate 06.

In addition, there is suggested (in JP-A-10-30423) an example in which an oil flow-down pipe is extended downwardly from a bottom plate constituting a gas-liquid separation chamber, and a lower end of the oil flow-down pipe is formed into an S-shape which faces laterally, whereby the oil flow-down pipe is closed with oil separated from blow-by gases to be collected in a bent portion of the S-shape which faces downwardly. However, this requires the special oil flow-down pipe and complicates the construction, where by the number of components is increased, resulting in a troublesome assembling process.

Additionally, with an oil flow-down pipe of a large diameter, oil does not flow out, and a large amount of oil is accumulated therein, whereas with an oil flow-down pipe of a small diameter, oil accumulated in the oil flow-down pipe is caused to flow back to be easily blown up into the gas-liquid separation chamber due to a negative pressure produced in the intake system.

The oil return gaps 011 are closed with oil which tries to flow out there through so as to prevent blow-by gases present within the cylinder head cover 03 from being blown up into the gas-liquid separation chamber 07 through the oil return gaps 001.

Moreover, once blow-by gases have flowed into the gas-liquid separation chamber 07 through the blow-by gas inlet port 09, a flow of the blow-by gases is formed as indicated by broken line arrows in FIG. 8 which flow is directed over the gas-liquid separation chamber 07 toward the blow-by gas outlet pipe 08.

Therefore, blow-by gases that have flowed into the gas-liquid separation chamber 07 through the blow-by gas inlet port 09 is allowed to act directly on oil accumulated in the oil return gap 011 due to the closure of the gap therewith, and oil is drawn into the blow-by gases to thereby be reversed.

This action makes it difficult for oil to flow out through the oil return gap 011, and if there is only a small amount of oil that closes the gap, the small amount of oil is drawn into the blow-by gases, whereby the gap 011 cannot be closed, resulting in the fact that blow-by gases are easy to be blown up, reducing the gas-liquid separation effect.

SUMMARY OF THE INVENTION

The invention was made in view of the drawbacks inherent in the conventional examples, and an object thereof is to provide a breather apparatus for an internal combustion engine which can prevent blow-by gases from being blown up into a gas-liquid separation chamber by closing an oil return port in an ensured fashion without accumulating a large amount of oil separated from blow-by gases in the gas-liquid separation chamber, and further can promote the gas-liquid separation effect with a simple construction.

With a view to attaining the object, according to a first aspect of the invention, there is provided a breather apparatus for an internal combustion engine in which an opening at a lower end of a circumferential wall of a cylinder head cover which defines an internal upper space within the cylinder head cover together with a top wall of the cylinder head cover is closed with a bottom plate so as to form a gas-liquid separation chamber, wherein the bottom plate is inclined when the internal combustion engine is set in a normal posture, further wherein an oil return port is formed at a lowest portion along an edge of a lower side of the inclined bottom plate, further wherein a blow-by gas inlet port is provided at a position along an edge portion of an upper side of the bottom plate which edge portion faces the oil return port, and further wherein a guide wall is provided for guiding flows of blow-by gases that have flowed through the blow-by gas inlet port toward the oil return port such that the flows of blow-by gases are deflected at right angles before the oil return port.

Since the guide wall deflects and guides at right angles the flow of blow-by gases that have flowed in through the blow-by gas inlet port toward the oil return port before the oil return port, the risk is avoided that the flow of blow-by gases acts on oil which is about to flow out through the oil return port to thereby draw oil back into the gas-liquid separation chamber, thereby making it possible to promote the gas-liquid separation effect.

According to a second aspect of the invention, there is provided a breather apparatus for an internal combustion engine in which an opening at a lower end of a circumferential wall of a cylinder head cover which defines an internal upper space within the cylinder head cover together with a top wall of the cylinder head cover is closed with a bottom plate so as to form a gas-liquid separation chamber, wherein the bottom plate is inclined when the internal combustion engine is set in a normal posture, further wherein an oil return port is formed at a lowest portion along an edge of a lower side of the inclined bottom plate, further wherein a blow-by gas inlet port is provided at a position along an edge portion of an upper side of the bottom plate which edge portion faces the oil return port, and further wherein the circumferential wall portion extending along the edge of the lower side of the inclined bottom plate is inclined downwardly toward the oil return port at the lowest portion.

According to the second aspect of the invention, the circumferential wall portion extending along the edge of the lower side of the inclined bottom plate inclines downwardly toward the oil return port situated at the lowest portion, and therefore, oil separated from the blow-by gases can smoothly be led to the oil return port so as to allow oil so led to flow out therethrough, thus the return of oil being facilitated to thereby improve the gas-liquid separation effect.

According to a third aspect of the invention, there is provided a breather apparatus for an internal combustion engine in which an opening at a lower end of a circumferential wall of a cylinder head cover which defines an internal upper space within the cylinder head cover together with a top wall of the cylinder head cover is closed with a bottom plate so as to form a gas-liquid separation chamber, wherein the bottom plate is inclined when the internal combustion engine is set in a normal posture, further wherein an oil return port is formed at a lowest portion along an edge of a lower side of the inclined bottom plate, further wherein a blow-by gas inlet port is provided at a position along an edge portion of an upper side of the bottom plate which edge portion faces the oil return port, and further wherein the oil return port is provided in an expanded portion formed at a position along the edge portion of the lower side of the bottom plate.

According to the third aspect of the invention, since the oil return port is provided in the expanded portion which is formed by being expanded from the edge of the lower side of the bottom plate to be situated at the lower position, the oil return port is allowed to be situated at the lowest position, whereby even if blow-by gases act on oil collected to the periphery of the oil return port, oil is prevented from being reversed by the difference in step between the unexpanded portion along the edge of the lower side of the bottom plate and the expanded portion.

According to a fourth aspect of the invention, there is provided a breather apparatus for an internal combustion engine in which an opening at a lower end of a circumferential wall of a cylinder head cover which defines an internal upper space within the cylinder head cover together with a top wall of the cylinder head cover is closed with a bottom plate so as to form a gas-liquid separation chamber, wherein the bottom plate is inclined when the internal combustion engine is set in a normal posture, and further wherein a recessed portion for holding oil is formed in a lowest portion along an edge of a side of a circumferential edge portion of the inclined bottom plate in such a manner as to straddle the circumferential wall from below so as to form an oil return port, the side constituting a lower side of the inclined bottom plate, whereby a lower end portion of the circumferential wall is brought into contact with oil held in the recessed portion to thereby close the oil return port airtightly.

According to the fourth aspect of the invention, since the recessed portion is formed at the lowest portion along the edge of the side of the inclined bottom plate which constitutes the lower side thereof, oil is allowed to be accumulated in the recessed portion at all times, and since the recessed portion is formed in such a manner as to straddle the circumferential wall from there below so as to form the oil return port, oil collected in the recessed portion overflows to be returned within the cylinder head cover through the oil return port, and blow-by gases from which oil contents are removed are returned to the intake system.

Since the lower end portion of the circumferential wall is brought into contact with oil held in the recessed portion to thereby close the gas-liquid separation chamber with the oil so held, it is possible to prevent blow-by gases within the cylinder head cover from being blown up through the oil return port into the gas-liquid separation chamber 06 together with oil, whereby oil consumption can be suppressed while maintaining high the gas-liquid separation effect.

According to a fifth aspect of the invention, there is provided a breather apparatus for an internal combustion engine according to the fourth aspect of the invention, wherein a portion of the circumferential wall which faces the recessed portion in the bottom plate is extended downwardly such that the extended portion enters oil held in the recessed portion, whereby it is possible to ensure that blow-by gases are prevented from being blown up through the oil return port into the gas-liquid separation chamber 06.

This construction can provide a similar effect to that obtained with the oil flow-down pipe without requiring the same pipe.

DETAILED DESCRIPTION OF THE PREFERRED EMBODIMENTS

Referring to FIGS. 1 to 5, an embodiment according to the invention will be described below.

Figure 1:
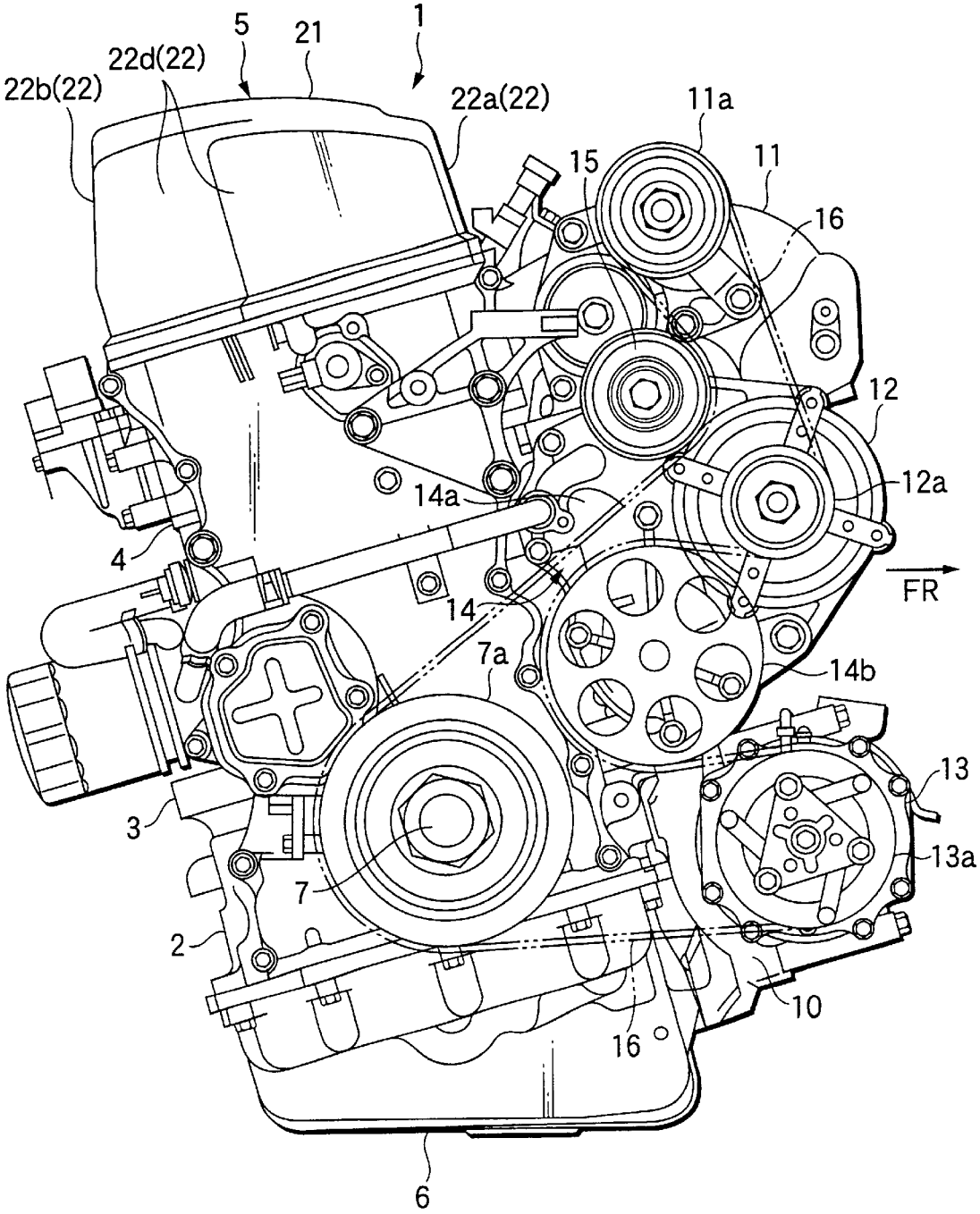
FIG. 1 is an overall side view of an internal combustion engine to which an embodiment of the invention is applied.

Shown in FIG. 1 is an overall side view of an internal combustion engine 1 to which a breather apparatus according the embodiment of the invention is applied.

The internal combustion engine 1 is a water-cooled four-cycle inline four-cylinder internal combustion engine and is mounted transversely with a crankshaft 7 being directed transversely.

Note that hereinafter in this specification a rear side denotes rearward; a left-hand side: leftward; and a right-hand side: rightward, as viewed ahead with a traveling direction of a vehicle being regarded as forward.

A cylinder block 3, a cylinder head 4, a cylinder head cover 5 are overlaid on a crankcase 2 in that order and are fastened together, and an oil pan 6 is joined to a lower surface of the crankcase 2.

When the internal combustion engine 1 is set in its normal posture, that is, when a body of a vehicle is not inclined, cylinders are inclined rearward from the vertical.

Mounted on a front side of the internal combustion engine 1 at a position closer to a right end thereof via an accessories bracket 10 are accessories such as a hydraulic pump 11, an AC generator 12, a compressor 13, and a water pump 14. Further, an endless belt 16 is hung between a drive pulley 7*a* fittingly secured on the crankshaft 7, an idler pulley 15, a driven pulley 11*a* of the hydraulic pump 11, a driven pulley 12*a* of the AC generator 12 and a driven pulley 14*a* of the water pump 14 and a driven pulley 13*a* of the compressor 13, so that those driven pulleys are driven all together.

Note that four intake pipes for the respective cylinders are provided so as to be arranged transversely on the left-hand side of the accessories from a front side of the cylinder head 4.

The cylinder head cover 5 overlaid on the cylinder head 4 is formed into a box shape opened downwardly by a top wall 21 and an outer circumferential wall 22. The outer circumferential wall 22 is formed into a substantially rectangular circumferential wall constituted by a longer front outer wall 22*a,* a longer rear outer wall 22*b,* a shorter left outer wall 22*c* and a shorter right outer wall 22*d.*

Figure 4:
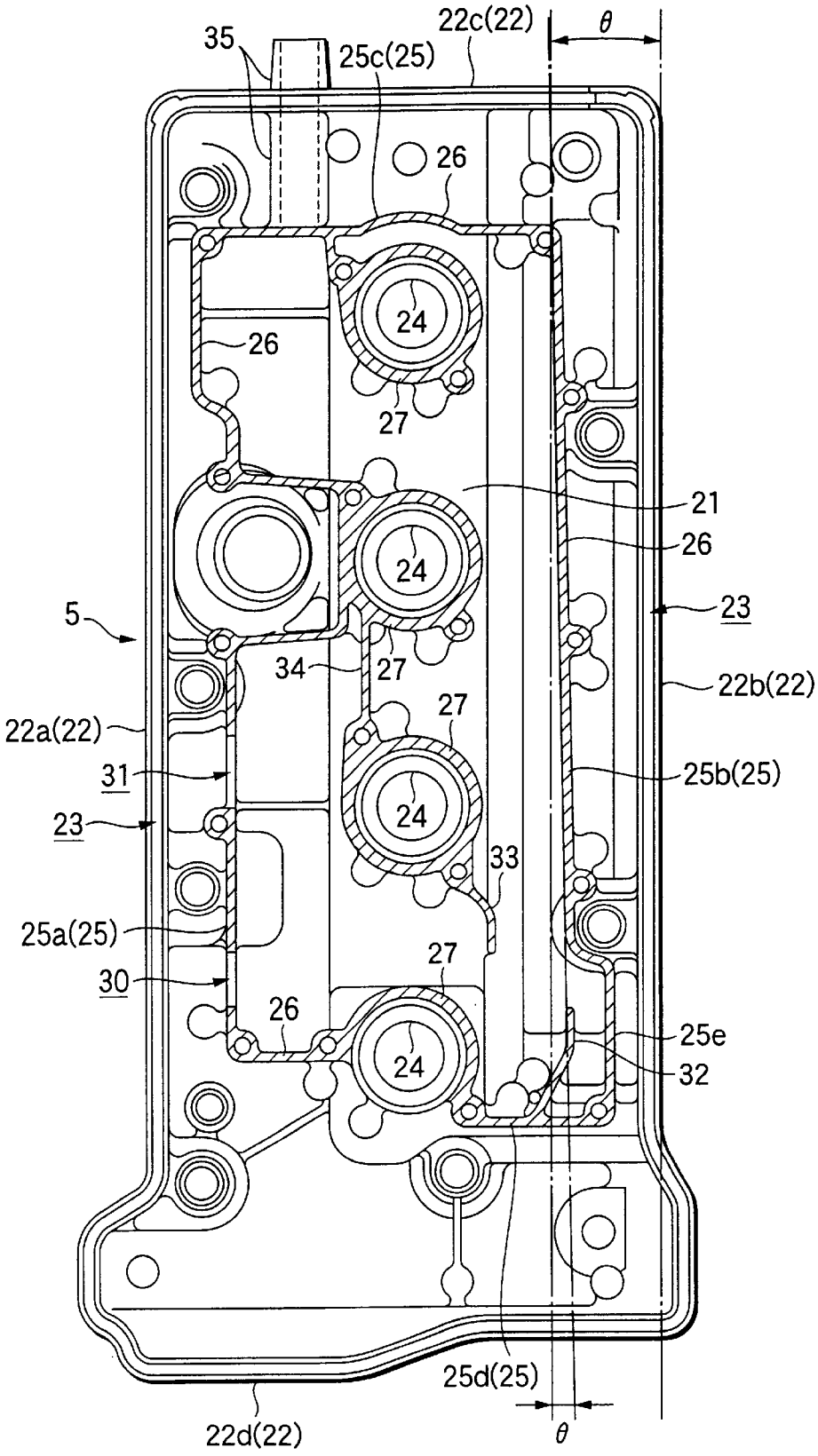
FIG. 4 is a bottom plan view as viewed from a matching surface of the cylinder head cover.

FIG. 4 shows a view of the cylinder head cover 5 as viewed from a mating surface thereof with the cylinder head 4.

An elongate groove 23 is formed in a substantially rectangular lower end mating surface of the outer circumferential wall 22 so that a seal material 7 (refer to FIG. 2) is fitted therein.

Four fitting tubes 24 which fittingly receive therein ignition plug holders 8 (refer to FIG. 2) are formed in the top wall 21 in such a manner as to be arranged in a transverse direction. A substantially rectangular inner circumferential wall 25 is formed so as to protrude downwardly from the top wall 21 in such a manner as to substantially surround the four fitting tubes 24.

The inner circumferential wall 25 is formed into a substantially rectangular shape by a longer front inner wall 25*a,* a longer rear inner wall 25*b,* a shorter left inner wall 25*c* and a shorter right inner wall 25*d,* which is of a size smaller than the outer circumferential wall 22. In addition, a distance over which the inner circumferential wall 25 protrudes downwardly from the top wall 21 is shorter than that of the outer circumferential wall 22, and a lower bottom end face 26 of the inner circumferential wall 25 which exists on the same plane is situated inwardly of the outer circumferential wall 22 and defines the upper internal space within the cylinder head cover 5 together with the top wall 21.

The four fitting tubes 24 also extend downwardly and stepped portions 27 are formed at intermediate positions along the lengths of the fitting tubes 24 in such a manner as to be situated on the same plane as the lower end face 26 of the inner circumferential wall 25.

The portions which are situated on the same plane as the lower end face 26 of the inner circumferential wall 25 are indicated by dotted patterns in FIG. 4.

The plane of the lower end face 26 of the inner circumferential wall 25 is in parallel to the lower end face of the outer circumferential wall 22 and is inclined downwardly toward the rear along the inclination of the cylinders of the internal combustion engine, thus the rear inner wall 25*b* being situated at a lower position than the front inner wall 25*a*.

Figure 2:
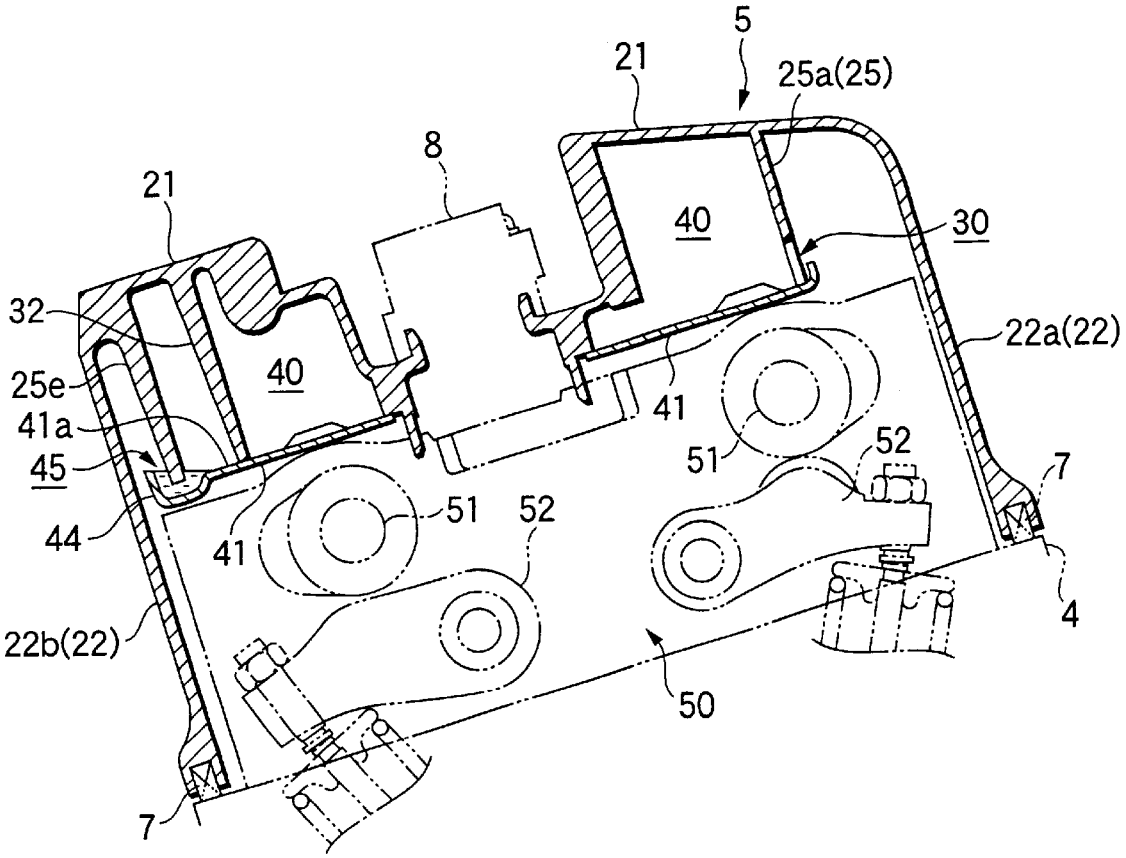
FIG. 2 is a cross-sectional view of a main part of the same internal combustion engine(a cross-sectional view taken along the line II—II in FIG. 3)

Referring now to FIGS. 2 and 4, this rear inner wall 25*b* situated on the lower side is inclined through an angle θ such that the rear inner wall 25*b* gradually approaches the rear outer wall 22*b* (that is, the rear inner wall 25*b* gradually becomes shorter than the rear outer wall 22*b*) as the former extends from the left to the right, and a right end portion of the rear inner wall 25*b* is expanded further outwardly to thereby form an expanded wall 25*e*.

Consequently, in the inner circumferential wall 25, the right end portion is situated at a position which is lower than any other portions of the rear inner wall 25*b* which is situated lower than any other inner walls of the inner circumferential wall 25, and the expanded wall 25*e* is expanded to become much lower than the right end portion. Thus, the expanded wall 25*e* is situated at the lowest position in the inner circumferential wall 25.

Blow-by gas inlet ports 30, 31 which are notched in lower end portions of the front inner wall 25*a* are formed in a portion along the front inner wall 25*a* which faces the expanded wall 25*e* and another portion in the vicinity of the facing portion of the front inner wall 25*a*.

Additionally, formed within the inner circumferential wall 25 is a guide wall 32 extending leftward from the right inner wall 25*d* in such a manner as to be substantially parallel to the expanded wall 25*e,* whereas a guide wall 33 is formed on the second rightmost fitting tube 24 in such a manner as to extend rightward therefrom. Furthermore, an interrupting wall 34 is provided so as to extend between the second and third rightmost tubes 24, 24.

Then, a blow-by gas outlet pipe 35 is formed in such a manner as to protrude outwardly from a front portion on the left inner wall 25*c* of the inner circumferential wall 25 at a portion closer through the left outer wall 22*c* of the outer circumferential wall 22.

Thus, the interior of the inner circumferential wall 25 is constructed such that blow-by gases flowing into the inner circumferential wall 25 from the blow-by gas inlet ports 30, 31 are caused to flow uniformly over the whole length and breadth of the interior by means of the guide walls 32, 33 and the interrupting wall 34 to flow out of the blow-by gas outlet pipe 35.

A bottom plate 41 is brought into abutment with the lower end face 26 of the inner circumferential wall 25 to be joined thereto, whereby the opening at the lower end of the inner circumferential wall 25 is closed with the bottom plate 41 so as to form a gas-liquid separation chamber 40.

Namely, the gas-liquid separation chamber 40 is formed within the upper internal space in the cylinder head cover 5 by the top wall 21 of the cylinder head cover 5, the inner circumferential wall 25 and the bottom plate 41.

As shown in FIG. 2, a valve train 50 including camshafts 51 and rocker arms 52 is accommodated in a space below the gas-liquid separation chamber 40 in the internal space of the cylinder head cover 5.

Figure 5:
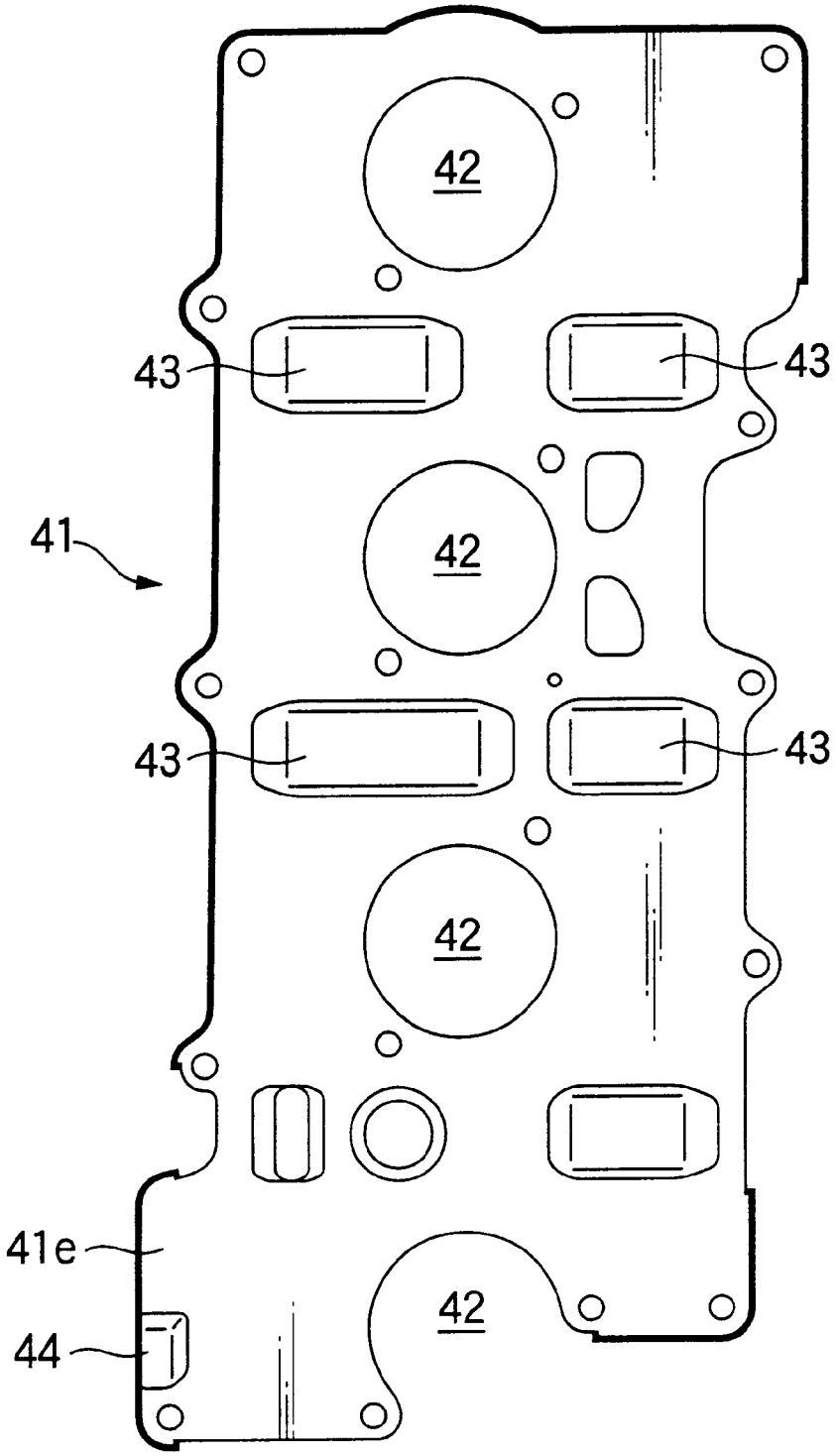
FIG. 5 is a top plan view of the bottom plate.

The bottom plate 41 is, as shown in FIG. 5, a substantially rectangular flat plate which conforms to the lower end face 26 of the inner circumferential wall 25, and four circular holes 42 (the circular hole at a right end of the plate is partially cut away) are formed in the bottom plate 41 in such a manner as to correspond to the four fitting tubes 24 on the cylinder head cover 5, respectively. In addition, bulge portions 43 which are bulged upwardly are formed in the bottom plate 41 at portions corresponding to cams of the camshafts 51 of the valve train 50.

Furthermore, the bottom plate 41 has an extended portion 41*e* which is extended so as to match the expanded wall 25*e* at the right end in the rear of the circumferential wall 25, and a recessed portion 44 of a small capacity is formed at a position along a part of a rear edge of the extended portion 41*e*, the recessed portion 44 being recessed downwardly.

Figure 3:
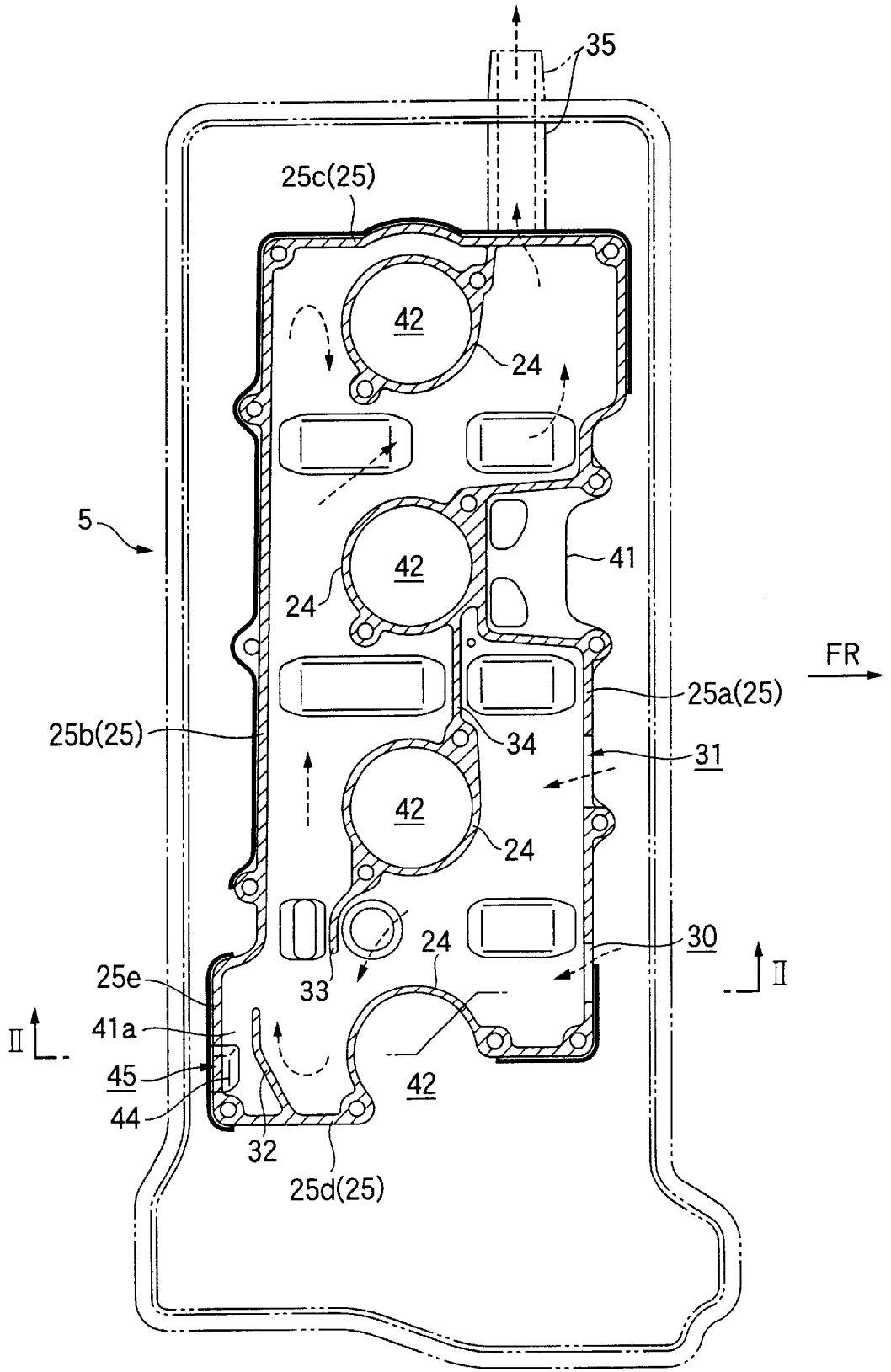
FIG. 3 is a top plan view of a bottom plate as viewed through a cylinder head cover from above.

A state in which the bottom plate 41 constructed as described above abuts with the lower end face 26 of the inner circumferential wall 25 of the cylinder head cover 5 to be joined thereto is shown in FIG. 3 as a plan view as viewed through the cylinder head cover 5 from above.

The cylinder head cover 5 is indicated by imaginary lines (two-dot chain lines).

A surface where the cylinder head cover 5 abuts with the bottom plate 41 is indicated by dot patterns in FIG. 3. The lower end face 26 of the inner circumferential wall 25 abuts with the bottom plate 41 along a circumferential edge thereof so as to close the gas-liquid separation chamber 40.

The gas-liquid separation chamber 40 opens to the interior of the cylinder head cover 5 through the two blow-by gas inlet ports 30, 31 formed closer to the right end of the front inner wall 25*a*, communicates with the outside through the blow-by gas outlet pipe 35 provided in the left inner wall 25*c* and, furthermore, opens to the interior of the cylinder head cover 5 through the recessed portion 44 which is recessed downward of the expanded wall 25*e* at the right end of the rear inner wall 25*b* and the bottom plate 41 to thereby form an oil return port 45.

As shown in FIG. 2, the recessed portion 44 in the bottom plate 41 is formed such that the same portion straddles the expanded wall 25*e* from therebelow, and the oil return port 45 passes under the expanded wall 25*e* along the recessed portion 44 to open.

As has been described before, since the plane of the lower end face 26 of the inner circumferential surface 25 inclines downwardly rearward along the inclination of the cylinders of the internal combustion engine, the bottom plate 41 which is brought into abutment with the lower end face 26 of the inner circumferential wall 25 also inclines downwardly rearward.

In addition, as has also been described before, since the rear inner wall 25*b* on the lower side of the inner circumferential wall 25 inclines such that the rear inner wall 25*b* gradually becomes lower as it extends from the left to the right thereof, and since the expanded wall 25*e* at the right end portion of the rear inner wall 25*b* is situated at the lowest position, an expanded portion 41 of the bottom plate 41 adapted to be brought into abutment with the expanded wall 25*e* is situated at a lowest position of the bottom plate 41.

Consequently, oil separated in the gas-liquid separation chamber 40 mainly flows rearward over the bottom plate 41 which inclines downwardly rearward, is guided smoothly along the rear inner wall 25*b* which inclines downwardly toward the right end thereof which is situated lower, and is introduced into the extended portion 41*a* in the bottom plate 41 along the expanded wall 25*e*.

The oil introduced into the extended portion 41*a* enters the recessed portion 44 so as to be accumulated therein.

When a suitable amount of oil is accumulated in the recessed portion 44, as shown in FIG. 2, the lower end of the expanded wall 25*e* contacts the surface of oil so accumulated.

When the lower end of the expanded wall 25*e* contacts oil so held in the recessed portion 44, the oil return port 45 is airtightly closed with the oil so accumulated.

In the event oil further flows into the recessed portion 44 even after the recessed portion 44 is filled with oil so collected, oil overflows from the recessed portion 44 and is returned from the oil return port 45 into the space below the gas-liquid separation chamber 40 where the valve train 50 is accommodated.

Once oil is accumulated in the recessed portion 44, since the suitable amount of oil is held therein at all times, the lower end of the expanded wall 25*e* is in contact with the level of oil so accumulated at all times, whereby the oil return port 45 is closed airtightly.

Consequently, blow-by gases within the space where the valve train 50 is accommodated is prevented from being blown up into the gas-liquid separation chamber 40 together with oil through the oil return port 45, thereby making it possible to suppress the oil consumption while maintaining high the gas-liquid separation effect in the gas-liquid chamber 40.

Even if oil is reversed through the oil return port 45 to thereby cause blow-by gases to be blown up, since the amount of oil accumulated in the recessed portion 44 of the small capacity is small, the oil consumption can be suppressed as low as possible.

Further, the breather apparatus according to the embodiment is a simple structure wherein the recessed portion 44 is formed in a part of the bottom plate 41.

Incidentally, according to the embodiment, the lower surface of the expanded wall 25*e* is disposed on the same plane as the lower surface 26 being a part of the inner circumferential wall 25. On the other hand, a portion of the expanded wall 25*e* which corresponds to the recessed portion 44 may be constructed to further extend downwardly so that a tip end of the expanded wall 25*e* is deeply intruded into the oil accumulated in the recessed portion 44. With this structure, the oil return port 45 is closed further airtightly to thereby securely prevent the blow-by gases from being blown up into the gas-liquid separation chamber 40.

On the other hand, blow-by gases which have flowed into the gas-liquid separation chamber 40 through the blow-by gas inlet ports 30, 31 is guided by means of the fitting tubes 24 and the guide walls 32, 33 as indicated by broken line arrows of FIG. 3 so as to establish a long flow path so that blow-by gases so guided flows uniformly over the whole length and breadth of the interior of the gas-liquid separation chamber 40. In the course of flowing as such, blow-by gases come to contact the inner wall surfaces, whereby oil contents of the blow-by gases are allowed to adhere to the inner wall surfaces to thereby promote the separation of oil contents from the blow-by gases, and the blow-by gases from which oil contents have been removed are allowed to flow out through the blow-by gas flow out pipe 35 so as to be supplied to the intake system.

Referring to FIG. 3, since the guide walls 32, 33 are disposed at the positions where flows of blow-by gases that have flowed into the gas-liquid separation chamber 40 through the blow-by gas inlet ports 30, 31 are collected to thereby provide a fastest flow rate, at right angles relative to such a flow, oil splashes in blow-by gases are allowed to easily adhere to the wall surfaces to promote further the separation of oil from the blow-by gases.

In addition, since the guide wall 32 blocks the recessed portion 44 and the oil return port 45 from the flows of blow-by gases, it is possible to prevent oil accumulated in the recessed portion from being drawn into the flows of blow-by gases to be thereby reversed, whereby making it possible to promote further the vapor and liquid separation effect with the simple construction in which the guide wall 32 is provided.

As has been described before, since oil separated from blow-by gases in the vapor and liquid separation chamber 40 flows down toward the lower right end of the inclined rear inner wall 25*b* therealong, oil is smoothly led to the oil return port 45, thereby making it possible to improve further the vapor and liquid separation effect.

Figure 6:
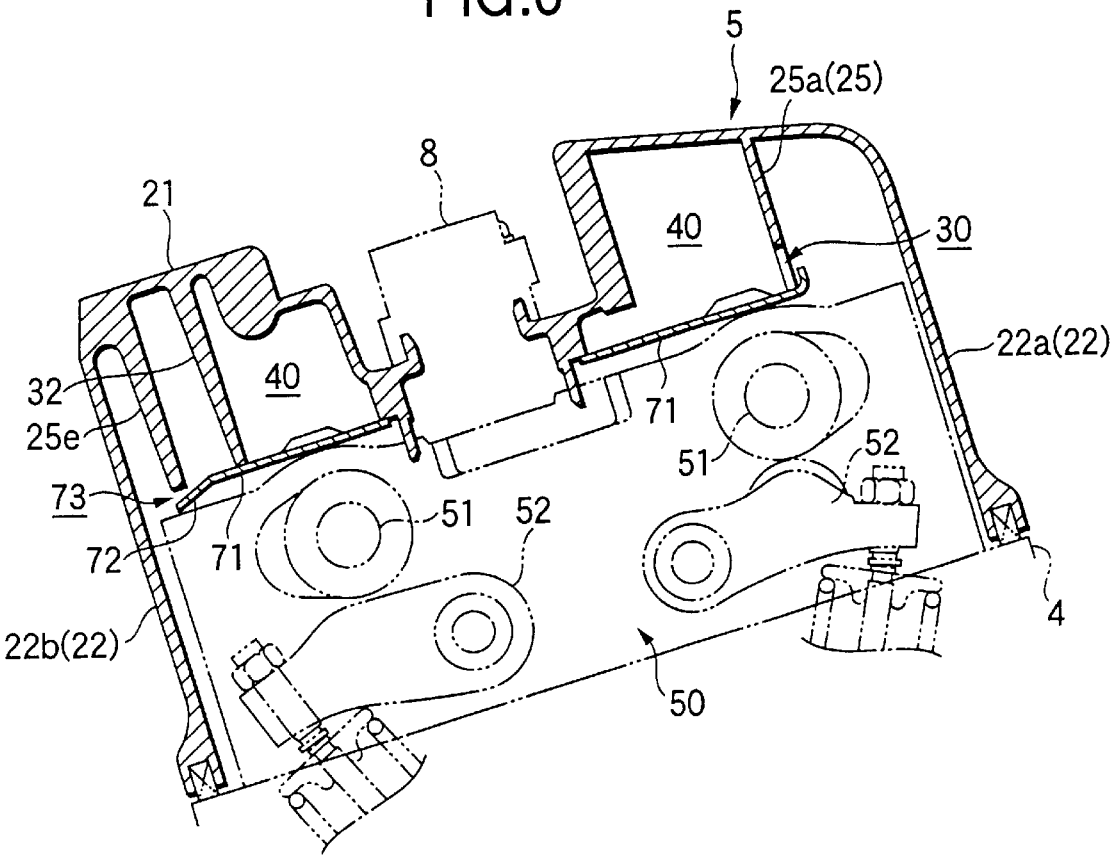
FIG. 6 is a cross-sectional view of a main part of a breather apparatus according to another embodiment.
Figure 7:
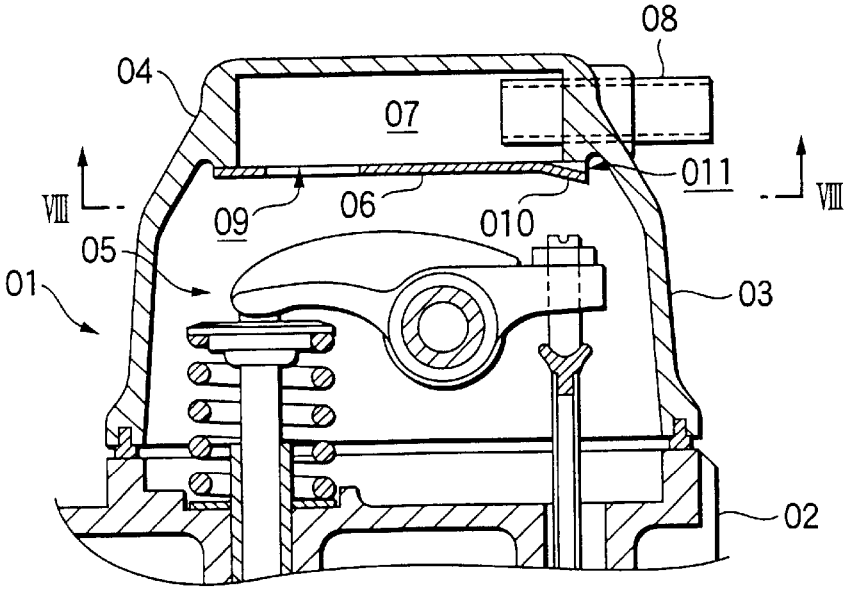
FIG.7 PRIOR ART
FIG. 7 is across-sectional view of a conventional cylinder head cover portion.
Figure 8:
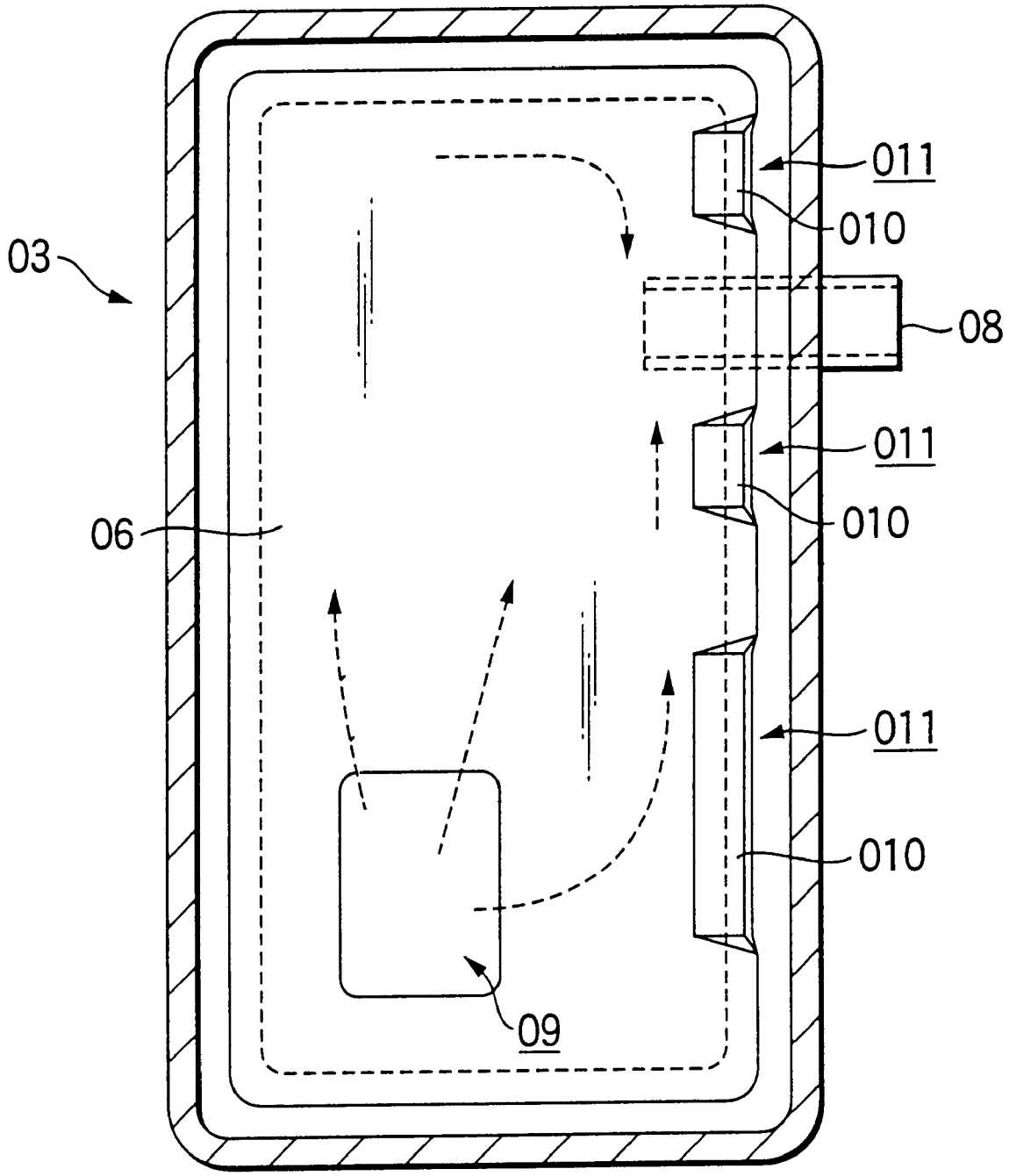
FIG.8 PRIOR ART
FIG. 8 is a cross-sectional view taken along the line VIII—VIII in FIG. 7.

In the above embodiment, while the recessed portion 44 is formed in the oil return port 45 in the bottom plate 41, as shown in FIG. 6, a bent portion 72 may be formed by bending downwardly a relevant portion of a bottom plate 71.

The other portions of this embodiment are similar to those in the previous embodiment, and hence like reference numerals are given to like components or portions.

A gap between the bent portion 72 of the bottom plate 71 and an expanded wall 25*e* constitutes an oil return port 73. Oil separated from blow-by gases in a vapor and liquid separation chamber 40 is led to the oil return port 73 so as to be allowed to flow out through the oil return port 73 into a space in which a valve train 50 is accommodated and serves to close the oil return port 73 to thereby prevent the blow-up of blow-by gases.

Oil closing the oil return port 73 and hence accumulating therein is blocked by a guide wall 32 from the flow of blow-by gases that have flowed from the blow-by gas inlet port 30 to thereby prevent oil from being drawn into the flow of blow-by gases, the vapor and liquid separation effect being thus promoted.

While only certain embodiments of the invention have been specifically described herein, it will apparent that numerous modifications may be made thereto without departing from the spirit and scope of the invention.

What is claimed is:

1. An internal combustion engine with a breather apparatus, comprising:

a cylinder head cover having a top wall and a circumferential wall which define an internal upper space within said cylinder head cover; and a bottom plate closing an opening at a lower end of the circumferential wall of said cylinder head cover so as to form a gas-liquid separation chamber, wherein said bottom plate is inclined when said internal combustion engine is set in a normal posture, further wherein an oil return port is formed at a lowest portion along an edge portion of a lower side of said inclined bottom plate, further wherein a blow-by gas inlet port is provided at a position along an edge portion of an upper side of said bottom plate, the position facing said oil return port; and further wherein a guide wall is provided for guiding flows of blow-by gases that are flowed through said blow-by gas inlet port toward said oil return port such that said flows of blow-by gases are deflected at substantially right angle before said oil return port.

2. An internal combustion engine with a breather apparatus according to claim 1, wherein said circumferential wall extending along said edge of said lower side of said inclined bottom plate is inclined downwardly toward said oil return port at the lowest portion.

3. The internal combustion engine with a breather apparatus according to claim 1, wherein said oil return port is provided in an expanded portion formed at a position along said edge portion of said lower side of said bottom plate.

4. An internal combustion engine with a breather apparatus, comprising:

a cylinder head cover having a top wall and a circumferential wall which define an internal upper space within said cylinder head cover; and a bottom plate closing an opening at a lower end of the circumferential wall of said cylinder head cover so as to form a gas-liquid separation chamber, wherein said bottom plate is inclined when said internal combustion engine is set in a normal posture, further wherein an oil return port is formed at a lowest portion along an edge portion of a lower side of said inclined bottom plate, further wherein a blow-by gas inlet port is provided at a position along an edge portion of an upper side of said bottom plate, the position facing said oil return port, and further wherein said circumferential wall extending along said edge of said lower side of said inclined bottom plate is inclined downwardly toward said oil return port at the lowest portion.

5. An internal combustion engine with a breather apparatus according to claim 4, wherein said oil return port is provided in an expanded portion formed at a position along said edge portion of said lower side of said bottom plate.

6. An internal combustion engine with a breather apparatus, comprising:

a cylinder head cover having a top wall and a circumferential wall which define an internal upper space within said cylinder head cover; and a bottom plate closing an opening at a lower end of the circumferential wall of said cylinder head cover so as to form a gas-liquid separation chamber, wherein said bottom plate is inclined when said internal combustion engine is set in a normal posture, and further wherein a recessed portion for holding oil and serving as an oil return port is formed in a lowest portion along an edge portion of a lower side of a circumferential edge portion of said inclined bottom plate in such a manner as to straddle said circumferential wall from below, whereby a lower end portion of said circumferential wall is brought into contact with oil held in said recessed portion to thereby close said oil return port airtightly.

7. An internal combustion engine with a breather apparatus according to claim 6, wherein a portion of said circumferential wall which faces said recessed portion in said bottom plate is extended downwardly such that said extended portion enters oil held in said recessed portion.

8. An internal combustion engine with a breather apparatus according to claim 6, wherein a blow-by gas inlet port is provided at a position along an edge portion of an upper side of said bottom plate, the position facing said oil return port, and further wherein a guide wall is provided for guiding flows of blow-by gases that are flowed through said blow-by gas inlet port toward said oil return port such that said flows of blow-by gases are deflected at substantially right angle before said oil return port.

9. An internal combustion engine with a breather apparatus according to claim 6, wherein a blow-by gas inlet port is provided at a position along an edge portion of an upper side of said bottom plate, the position facing said oil return port, and further wherein said circumferential wall extending along said edge of said lower side of said inclined bottom plate is inclined downwardly toward said oil return port at the lowest portion.

10. An internal combustion engine with a breather apparatus according to claim 6, wherein a blow-by gas inlet port is provided at a position along an edge portion of an upper side of said bottom plate, the position facing said oil return port, and further wherein said oil return port is provided in an expanded portion formed at a position along said edge portion of said lower side of said bottom plate.

* * * * *